US005829268A

United States Patent [19]

Mertens

[11] Patent Number: 5,829,268

[45] Date of Patent: Nov. 3, 1998

[54] MULTI-CHAMBER EXPANSION DEVICE FOR A VEHICLE COOLING OR HEATING CIRCUIT

[75] Inventor: Klaus Mertens, Elancourt, France

[73] Assignee: Valeo Thermique Moteur, Le Mesnil-Saint-Denis, France

[21] Appl. No.: 802,375

[22] Filed: Feb. 19, 1997

[30] Foreign Application Priority Data

Feb. 20, 1996 [FR] France ..... 9602067

[51] Int. Cl.[6] ..... F25B 43/00

[52] U.S. Cl. ..... 62/503; 123/41.54; 165/104.32

[58] Field of Search ..... 123/41.54; 165/104.32; 62/503

[56] References Cited

U.S. PATENT DOCUMENTS

| | | | |
|---|---|---|---|
| 4,480,598 | 11/1984 | Berrigan | 123/41.54 |
| 4,512,396 | 4/1985 | Villeval | 123/41.54 |
| 4,580,622 | 4/1986 | Sigonneau | 165/104.32 |
| 4,738,228 | 4/1988 | Jenz et al. | 123/41.54 |
| 5,135,049 | 8/1992 | Attinger et al. | 165/104.32 |
| 5,329,889 | 7/1994 | Caldwell | 123/41.54 |
| 5,457,218 | 10/1995 | Theorell | 123/41.54 |

FOREIGN PATENT DOCUMENTS

| | | |
|---|---|---|
| 0 213 414 | 3/1987 | European Pat. Off. . |
| 0 215 369 | 3/1987 | European Pat. Off. . |
| 2 722 834 | 1/1996 | France . |

*Primary Examiner*—Ronald C. Capossela
*Attorney, Agent, or Firm*—Morgan & Finnegan, LLP

[57] ABSTRACT

A multi-chamber expansion device for a vehicle cooling or heating circuit consists of a single vessel in which the three successive chambers of the expansion device are aligned horizontally within a rigid elongate casing, which is formed by two moulded hollow members welded together along their respective peripheral edges in a vertical junction plane. These edges are thickened and formed with a groove which extends over substantially the whole periphery of the vessel, at the joint between the two casing members. This groove is interrupted by integral bridges so as to define ducts which connect together, firstly the first and second chambers, and secondly the second and third chambers, through a pressure-limiting valve.

10 Claims, 2 Drawing Sheets

MULTI-CHAMBER EXPANSION DEVICE FOR A VEHICLE COOLING OR HEATING CIRCUIT

FIELD OF THE INVENTION

This invention relates to an expansion device for a heat transfer fluid flowing in a circuit, in particular a circuit for cooling and/or heating purposes in a motor vehicle, and the like. The device comprising at least one first chamber and a second chamber. These chambers are connected together through a first duct open into the upper part of the first chamber, in such a way as to enable liquid or gas to be transferred into the second chamber as a result of expansion of the liquid in the circuit. A pressure-limiting safety valve is adapted to open, to allow the liquid or gas to escape from the second chamber, when the pressure in the latter reaches a predetermined value.

BACKGROUND OF THE INVENTION

Such an expansion device is designed to absorb the variations in volume in the heat transfer fluid that occur during the operation of the circuit. These variations in volume are due to variations in the temperature of the fluid and, where appropriate, to its changes of state when it is a fluid of a kind that operates in both the liquid and gaseous states. The gaseous phase which is present above the liquid in the first chamber, and which can pass into the second chamber, consists of air and/or, where appropriate, the heat transfer fluid in its gaseous state. The presence of the second chamber enables the height available in the first chamber above the minimum level of liquid to be reduced. This has the effect of reducing the overall height of the system, because the minimum liquid level has to be situated above the whole of the cooling or heating circuit.

It is also known to provide a third chamber, with at least one second duct connecting the second and third chambers through the above mentioned safety valve (referred to herein as the first safety valve), together with a second pressure-limiting safety valve which is arranged to open, in order to allow the gas to escape from the third chamber, when the pressure in the third chamber reaches a predetermined second value higher than the above mentioned first value. The third chamber enables heat transfer fluid in the gaseous state that has escaped from the second chamber to be recovered and condensed. The opening pressure of the first safety valve corresponds to the maximum normal operating pressure of the circuit, and the opening pressure of the second safety valve corresponds a pressure that must not be exceeded for safety reasons.

In known multi-chamber expansion devices, each one of the various chambers has its own separate casing. These casings are connected together through ducts in the form of separate pipes.

DISCUSSION OF THE INVENTION

The object of the invention is to simplify the structure and manufacturing operations of the expansion device, and to reduce its size.

According to the invention, an expansion device for a heat transfer fluid flowing in a circuit, especially a cooling and/or heating circuit in a motor vehicle, the device comprising: at least one first chamber and a second chamber which are connected together through a first duct open into the upper part of the first chamber, in such a way as to enable liquid or gas to be transferred into the second chamber as a result of expansion of the fluid in the circuit. A first pressure-limiting safety valve is adapted to open so as to allow the liquid or gas to escape from the second chamber when the pressure in the latter reaches a predetermined first value, is characterised in that the first and second chambers and the first duct are defined by a common rigid casing. The first duct extends along the outer wall of the casing, the first safety valve being fixed to the latter.

According to a preferred feature of the invention, the first duct is defined within a thickened portion of the outer wall of the casing.

According to another preferred feature of the invention, the casing consists of at least two hollow moulded casing members which are assembled together in sealing relationship edge to edge, in particular by adhesive bonding or welding. A groove is formed along the assembly edge of at least a first one of the casing members, so as to constitute the first duct.

According to a further preferred feature of the invention, the casing defines a third chamber and at least one second duct. The second duct connects the second and third chambers through the first safety valve, and the casing carries a second pressure-limiting safety valve. The second safety valve is adapted to open in order to allow gas to escape from the third chamber when the pressure in the third chamber reaches a predetermined second value greater than the first predetermined value.

Preferably, the casing defines second and third ducts which connect the second and third chambers, respectively, to the first safety valve, together with a fourth duct which connects the third chamber to the second safety valve, all of these ducts being formed within thickened portions of the outer wall of the casing.

Preferably, the casing has a horizontally elongated form having a substantially uniform transverse cross-section, the three chambers being aligned between a first and a second end of the casing, and being separated from each other by two transverse bulkheads.

According to yet another preferred feature of the invention, the casing comprises two casing members which are assembled together along a longitudinal junction plane, with the four ducts extending in the junction plane. This junction plane is preferably substantially vertical, and the first duct preferably extends in the form of a groove formed along the edge of the said first casing member, from a junction zone in which it is open into the first chamber, and which is situated on the upper side of the edge, to a further junction zone in which the groove is open into the second chamber, and which is situated on the lower side of the edge, the groove passing through the first end of the casing, and the third chamber being adjacent to the second end of the casing.

The first and second safety valves are preferably disposed on the outside of the second end of the casing, on either side, respectively, of the junction plane.

The first, second and third chambers are preferably aligned in that order between the first and second ends of the casing.

According to a still further preferred feature of the invention, the second and third ducts extend in the form of a first groove formed along the assembly edge of the first casing member. The second duct extends from a junction zone in which it is open into the second chamber and which is situated on the upper side of the assembly edge, to the second end of the casing. The third duct extends from the second end of the casing, below the second duct, to a junction zone in which the third duct is open into the third chamber and which is situated on the lower side of the assembly edge. The groove is interrupted by an integral bridge formed by molding to separate the second and third ducts from each other at the second end of the casing. The groove being connected to the inlet and outlet of the first safety valve, above and below the bridge respectively, through respective cavities which are formed in the wall of the casing.

Preferably, the fourth duct is defined by a second groove in the edge of the first casing member at the second end of the casing. This second groove being juxtaposed, towards the interior of the casing, to that region of the first groove that defines the second duct, the first duct being in communication with the third chamber at its upper end and being closed at its lower end, the lower end being connected to the inlet of the second safety valve through a cavity formed in the wall of the casing.

According to yet another preferred feature of the invention, the first groove extends over substantially the whole peripheral length of the edge of the first casing member to define the first, second and third ducts(and which is constituted for example by the above mentioned integral bridge), the first groove having, apart from the interruption at the second casing end that separates the second and third ducts, at least one interruption on the upper side between the upstream ends of the first and second ducts, together with a least one further interruption on the lower side between the downstream ends of the first and third ducts.

The various features and advantages of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 1:
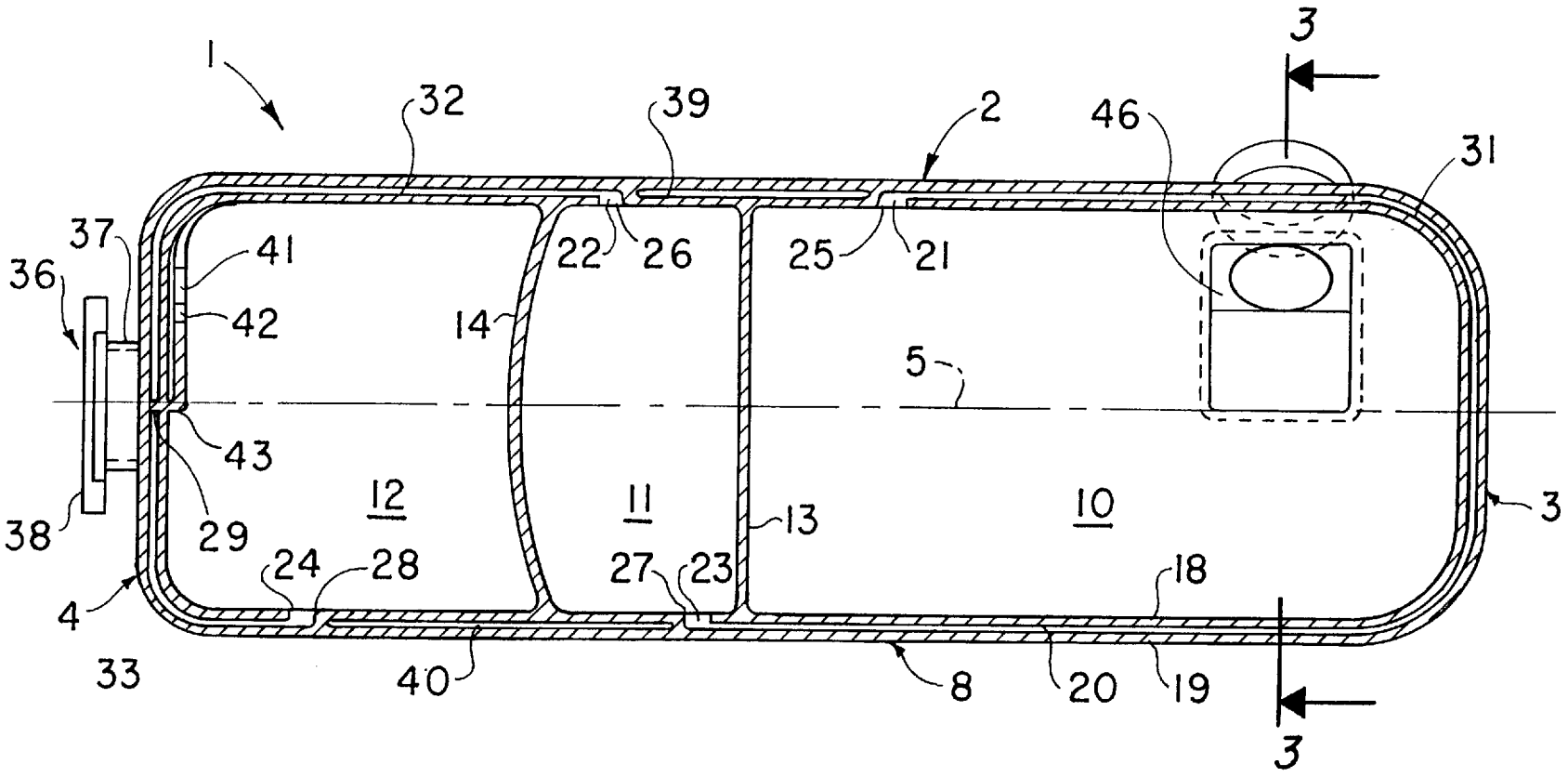
FIG. 1 is a view in longitudinal cross section of the casing of an expansion device in accordance with the invention.

The casing shown in the drawings has the general form of a cylinder of revolution having a tubular side wall 2 and two end walls, or casing end portions, 3 and 4, seen on the right hand side and left hand side, respectively, of FIG. 1. The central regions of the end walls 3 and 4 are flat and lie at right angles to the axis 5 of the casing. The end walls 3 and 4 are joined to the side wall 2 through rounded regions. The casing consists of two substantially semi-cylindrical hollow casing members 6 and 7 of moulded plastics material, having respective thickened peripheral edges 8 and 9 through which they are joined together by thermo-welding so as to form a vessel which is sealed to liquids and gas. The vessel is divided, considered from right to left in FIG. 1, into three chambers 10, 11 and 12, by means of transverse bulkheads 13 and 14. The bulkheads 13 and 14 are also formed by the welded assembly of the two components, the bulkhead 14 being bowed towards the chamber 12.

Figure 4:
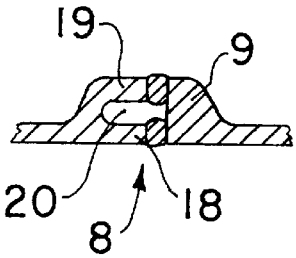
FIG. 4 is a detail view showing on a larger scale a detail from FIG. 3.

The two thickened edges 8 and 9, also referred to in this description and in the Claims as junction edges or assembly edges, are abutted together in a vertical junction plane P1, which is almost coincident with the vertical plane P2 that passes through the axis 5. The edges 8 and 9 of the members 6 and 7 define a strap element 15 which projects outwardly from the adjacent regions of the casing, and which extends right around the casing over its upper and lower sides and its end walls 3 and 4. On the upper and lower sides, the strap element 15 projects from respective horizontal flats 16 and 17, and lies within the circular profile of the tubular wall 2. The junction edge 8 has a fork-shaped profile, each of the two branches 18 and 19 of which has a width equal to the general thickness of the walls of the casing. The inner branch 18 is disposed within the alignment of the adjacent regions of the wall of the casing, and in particular that of the flats 16 and 17 on the upper and lower sides, while the outer branch 19 is substantially parallel to the inner branch 18. The gap between the two branches 18 and 19 of the thickened portion 8 defines a groove 20. The junction edge 9 of the member 7 has a thickness equal to that of the junction edge 8, and makes sealed contact, secured by welding(see FIG. 4), with the free ends of the branches 18 and 19, thus closing off the groove 20.

Four notches are formed in the inner branch 18 of the junction edge 8, namely two notches 21 and 22 on the upper side of the casing, and two notches 23 and 24 on its lower side. The notch 21 lies in line with the bulkhead 13, the notch 22 between the bulkheads 13 and 14, the notch 23 again between the bulkheads 13 and 14, and the notch 24 to the left of the bulkhead 14 (with reference to FIG. 1). In addition, the groove 20 is interrupted locally by five integral bridges which are formed during the moulding of the casing member 6. Four of these bridges, 25 to 28, lie, respectively: to the left of the notch 21; immediately to the right of the notch 22; immediately to the left of the notch 23; and immediately to the right of the notch 24. The fifth bridge, 29, lies at mid-height in the end portion 4 of the casing.

These five bridges define three ducts within the peripheral length of the groove 20, namely a first duct 31, a second duct 32, and a third duct 33. With reference to FIG. 1, the first duct 31 extends towards the right along the upper side of the casing, from the bridge 25, and then downwardly along the end portion 3 and towards the left along the lower side as far as the bridge 27. The first duct 31 is in upstream communication with the chamber 10 through the notch 21, and in downstream communication with the chamber 11 through the notch 23. The second duct 32 extends to the left with reference to FIG. 1, along the upper side of the casing from the bridge 26, and then downwardly along the end portion 4 as far as the bridge 29. It is in upstream communication with the chamber 11 through the notch 22. The third duct 33 extends downwardly along the end portion 4 from the bridge 29, and then continues towards the right along the lower side, as far as the bridge 28. The third duct 33 is in downstream communication with the chamber 12 through the notch 24.

Figure 2:
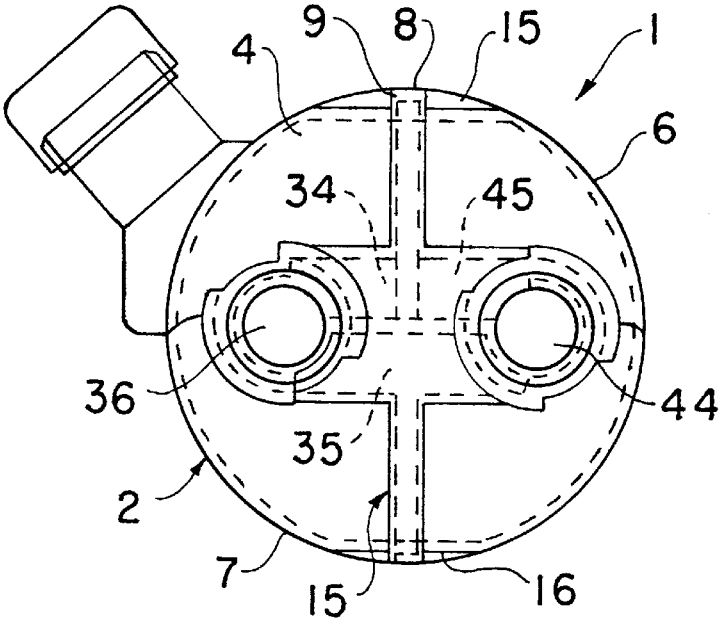
FIG. 2 is an end view as seen from the left hand side of FIG. 1.
Figure 3:
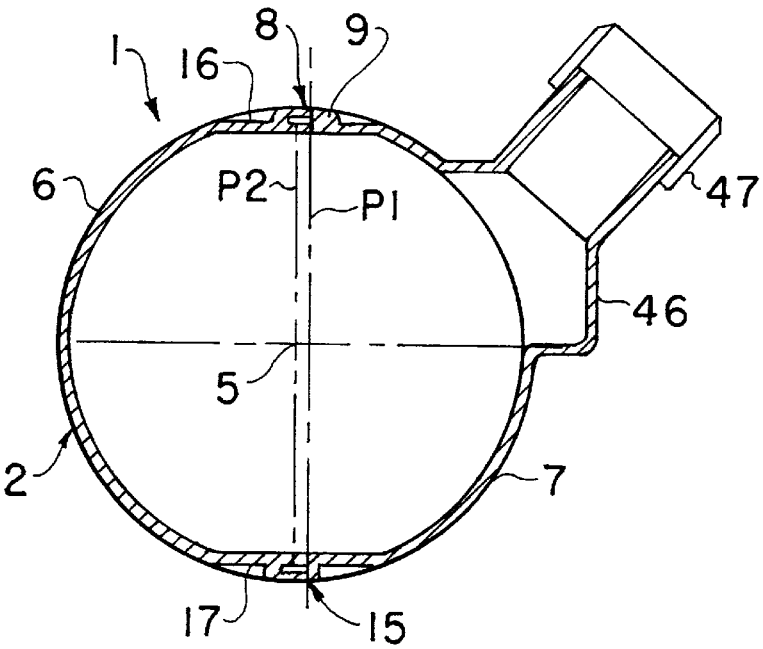
FIG. 3 is a view in cross section taken on the line III-III in FIG. 1.

The ducts 32 and 33 are completed by two cavities 34 and 35 (see FIG. 2), which are again formed in a thickened region of the wall of the casing, in its end portion 4. The cavities 34 and 35 put the groove 20 into communication, above and below the bridge 29, with the inlet and outlet, respectively, of a pressure-limiting valve 36, (referred to here for convenience as the first safety valve). The valve 36 consists of known components, not themselves shown, and is adapted, in particular, to enable gas to pass from the duct 32 to the duct 33 only when the pressure in the first of these exceeds a predetermined value. In this example this value is 0.4 bar.

The components of the valve 36 are accommodated within a space which is defined by an annular wall portion 37 and a removable cover 38. The wall portion 37 is formed integrally with the casing member 7, and projects on the outside of the casing from its end wall 4. The portions 39 and 40 of the groove 20, shown in FIG. 1, are disposed respectively between the bridges 25 and 26, and between the bridges 27 and 28, and constitute isolated cavities.

In the upper half of the end wall 4, the. profile of the junction edge 8 of the casing member 6 includes a third branch 41 which is parallel to the inner branch 18. This third branch 41 is offset towards the interior of the casing with respect to the branch 18, which is separated from it by a groove 42. The groove 42 is closed in the same way as the groove 20, by means of a region of the junction edge 9 of the casing member 7, the edge 9 having a thickened region accordingly. The groove 42 is in communication with the chamber 12 at its upper end, and is interrupted at mid-height of the end wall 4 by an integral bridge 43 which is effectively an extension of the bridge 29. The groove 42 is in communication with the inlet side of another valve 44 for limiting pressure, through a cavity 45 which is similar to the cavities 34 and 35, but which is situated towards the interior of the casing with respect to the general plane of the end wall 4. The valve 44 is a safety valve and is of similar construction to the valve 36, but is adjusted for an opening pressure of 0.7 bar. The valve 44 is located in symmetrical relationship with the safety valve 36 about the plane P2, and its output communicates with the atmosphere.

In the conventional way, the casing 1 has a filler pipe 46, which communicates with the chamber 10 and which is provided with a filler cap 47. The chamber 10 also communicates, through an inlet orifice and an outlet orifice, neither of which is shown, with the cooling and heating circuit with which the expansion device is associated.

Modifications can be applied to the device described above and shown in the drawings, without departing the scope of the present invention. Thus, the grooves which define the various ducts may be formed in both the casing members at once, with the junction plane P1 then being coincident the with plane of symmetry P2. The two bridges 25 and 26, which terminate the neutral portion 39 of the groove 20, may be replaced by a single bridge disposed between the notches 21 and 22, and the same can be done with the bridges 27 and 28.

What is claimed is:

1. A heat transfer fluid expansion device, the device comprising means defining at least one first chamber having a first part, a filler pipe in fluid communication with said first chamber for the heat transfer fluid ingress to the expansion device, means defining a second chamber for the device, and means for defining a first duct joining said first and second chambers together, said first duct being open into said first part of said first chamber whereby to transfer fluid into said second chamber in liquid and gaseous form following expansion of the heat transfer fluid, the expansion device further including a first pressure limiting valve and means for connecting said first valve with said second chamber, whereby to establish egress for the heat transfer fluid from the expansion device from said second chamber when the pressure in said second chamber reaches a predetermined first value, wherein the device has a single rigid casing defining said first and second chambers and said first duct, said casing having a wall, said first duct extending along said wall, and said first valve being fixed to said wall.

2. A device according to claim 1, wherein said wall of the casing has a thickened portion defining said first duct within said thickened portion.

3. A device according to claim 2, wherein said casing comprises at least two hollow molded members including a first casing member, having a first assembly edge, and another casing member having a second assembly edge, said casing members assembly edges being edge to edge with said first and second assembly edges being secured sealingly together, at least said first assembly edge defining a groove therewithin, said groove defining said first duct.

4. A device according to claim 1, wherein said casing further defines a third chamber having at least two ends thereon, at least one second duct, said second duct being open at one end into said second chamber and at said another end into said third chamber, said first valve being in fluid communication with said second duct between said two said second duct ends, the expansion device further including a second pressure limiting valve which is a safety valve, and means for establishing fluid communication between said second valve and said third chamber, said second valve being adapted to release the heat transfer fluid in gaseous form from said third chamber when the pressure in said third chamber reaches a predetermined second value greater than said first value.

5. A device according to claim 4, wherein said at least one second duct comprises a second duct connecting said second chamber to said first valve, and a third duct connecting said third chamber to said first valve, fourth duct means for connecting said third chamber with said second valve, said casing wall having portions of increased thickness defining said second, third and fourth ducts.

6. A device according to claim 5, wherein said casing has a horizontally elongate form with a first end portion and a second end portion having an outside surface at opposite ends of said casing, said casing defining a substantially uniform transverse cross-section and having a plurality of internal transverse bulkheads, said bulkheads separating said first, second and third chambers from each other, said chambers being aligned with each other between said first and second end portions of the casing.

7. A device according to claim 6, wherein said casing comprises first and second casing members defining a mutual longitudinal junction plane therebetween, said casing members being together in said junction plane, with said first, second, third and fourth ducts extending along said junction plane.

8. A device according to claim 7, in which said first casing member has an assembly edge defining said junction plane, said junction plane being substantially longitudinal, said assembly edge having a side defining a first junction zone and another side defining a second junction zone, said first assembly edge defining within it a groove for forming said first duct, said first duct communicating with said first chamber in said first junction zone and communicating with said second chamber in said second junction zone, said third chamber being adjacent to said second end portion of said casing, and said first duct extending within said first end portion of said casing.

9. A device according to claim 8, wherein:

said first and second valves are disposed on said second casing end portion outside surface, respectively on either side of said mutual longitudinal junction plane;

said first, second and third chambers are aligned in that order between said first and second casing end portions;

said first casing assembly edge defines a third junction zone in a part thereof and a fourth junction zone in another part thereof, said groove defined along said assembly edge being a first groove forming second and third ducts, with said second duct extending from said third junction zone to said second casing end portion, said second duct communicating with said second chamber in said third junction zone, said third duct extending from said second casing end portion, spaced from said second duct, to said fourth junction zone, and communicating with said third chamber in said fourth junction zone, said casing further defining an integral molded bridge in said second end portion to interrupt said first groove thereby separating said second and third ducts from each other, said first valve having an inlet and an outlet, said second duct being connected to said inlet of said first valve spaced from said bridge, said third duct being in fluid communication with said outlet of the first valve spaced from said bridge, and said casing wall defining a first cavity and a second cavity joining said second and third ducts to said inlet and said outlet of said first valve respectively;

said assembly edge of said first casing member further defines a second groove in said casing second end portion, said second groove defining said fourth duct with a first end and a second end, said fourth duct being juxtaposed, on the side of said casing wall nearest the interior of the casing, to the portion of said first groove the defines said second duct, and communicating with said third chamber at said one end thereof, being closed at said second end thereof, said casing wall further defining a third cavity, said second valve having an inlet, said fourth duct being in fluid communication with said inlet of said second valve through said third cavity.

10. A device according to claim 9, wherein said first groove extends over substantially the whole of said first casing member assembly edge to define said first, second and third ducts, including said bridge, said bridge being a first bridge, in said second casing end portion, separating said second and third ducts from each other, at least one second bridge in a part of said casing between said first and second ducts, and at least one third bridge in another part of said casing between said first and third ducts.

* * * * *